US011028550B2

(12) United States Patent
Gantt

(10) Patent No.: US 11,028,550 B2
(45) Date of Patent: Jun. 8, 2021

(54) PIER BRACKET ASSEMBLY

(71) Applicant: Independence Materials Group, LLC, Virginia Beach, VA (US)

(72) Inventor: William A. Gantt, Blair, SC (US)

(73) Assignee: Independence Materials Group, LLC, Virginia Beach, VA (US)

( * ) Notice: Subject to any disclaimer, the term of this patent is extended or adjusted under 35 U.S.C. 154(b) by 0 days.

(21) Appl. No.: 16/013,331

(22) Filed: Jun. 20, 2018

(65) Prior Publication Data

US 2018/0371716 A1 Dec. 27, 2018

Related U.S. Application Data

(60) Provisional application No. 62/522,433, filed on Jun. 20, 2017.

(51) Int. Cl.

*E02D 5/80* (2006.01)
*E02D 37/00* (2006.01)
*E02D 27/50* (2006.01)

(52) U.S. Cl.

CPC ..... *E02D 5/80* (2013.01); *E02D 27/50* (2013.01); *E02D 37/00* (2013.01); *E02D 2600/30* (2013.01)

(58) Field of Classification Search

CPC ..... E02D 5/80; E02D 27/50; E02D 37/00; E02D 2600/30

See application file for complete search history.

(56) References Cited

U.S. PATENT DOCUMENTS 4,673,315 A * 6/1987 Shaw ..... E02D 35/00 405/229
4,695,203 A * 9/1987 Gregory ..... E02D 35/00 254/29 R
4,930,270 A * 6/1990 Bevacqua ..... E04B 1/0007 248/188.4
4,996,806 A 3/1991 Platz
5,011,336 A * 4/1991 Hamilton ..... E02D 27/48 405/229
5,013,190 A * 5/1991 Green ..... E02D 35/00 254/29 R
5,120,163 A * 6/1992 Holdeman ..... E02D 27/48 405/229
5,139,368 A * 8/1992 Hamilton ..... E02D 27/48 405/229
5,205,673 A * 4/1993 Bolin ..... E02D 35/00 405/230
5,213,448 A * 5/1993 Seider ..... E02D 27/48 405/229
5,215,411 A 6/1993 Seegmiller
5,408,788 A 4/1995 Hamilton et al.

(Continued)

*Primary Examiner* — Rodney Mintz
(74) *Attorney, Agent, or Firm* — Moore & Van Allen PLLC; Jeffrey R. Gray

(57) ABSTRACT

A pier bracket comprises a seat including a base plate and an upper plate extending orthogonally from the base plate wherein, when the base plate is positioned for supporting a structure, the upper plate is adjacent to the structure for securing the upper plate to the structure. A tubular member is mounted to the seat and adapted to slidably receive structural piers. A planar support plate is distally spaced from and parallel to the base plate. Each of a pair of side plates extend between an opposite side edge of the base plate and the support plate.

20 Claims, 11 Drawing Sheets

(56) References Cited

U.S. PATENT DOCUMENTS

D362,613 S 9/1995 Lott
5,482,407 A 1/1996 Raaf
5,951,206 A * 9/1999 Gregory ..... E02D 35/00 405/229
6,142,710 A * 11/2000 Holland, Jr. ..... E02D 33/00 405/229
6,193,442 B1 * 2/2001 May ..... E02D 35/00 405/232
6,767,167 B1 * 7/2004 Rials ..... E02D 35/00 405/232
7,090,435 B2 8/2006 Mitchell
7,090,437 B2 8/2006 Pinkleton
7,165,915 B2 * 1/2007 Queen ..... E02D 27/48 405/232
7,220,081 B1 * 5/2007 Gantt, Jr. ..... E02D 27/12 405/230
7,402,002 B2 * 7/2008 Zidar ..... E02D 35/00 405/230
7,470,090 B2 * 12/2008 Heppner ..... E02D 5/56 248/219.3
7,635,240 B2 12/2009 Gantt, Jr.
D620,343 S 7/2010 Kortan et al.
8,079,781 B2 12/2011 Ronnkvist
8,206,063 B2 6/2012 Patton
8,714,880 B1 * 5/2014 Mitchell ..... E02D 35/005 405/230
8,777,520 B2 * 7/2014 Lin ..... E02D 5/523 405/229
2005/0214076 A1 * 9/2005 Faires ..... E02D 27/48 405/230
2005/0238442 A1 * 10/2005 Queen ..... E02D 27/48 405/230
2006/0269364 A1 * 11/2006 May ..... E02D 5/56 405/232
2007/0231080 A1 * 10/2007 Gregory ..... E02D 27/12 405/230
2007/0286684 A1 * 12/2007 Heppner ..... E02D 5/56 405/230
2008/0014028 A1 * 1/2008 Faires ..... E02D 27/16 405/230
2008/0170912 A1 * 7/2008 Kaufman ..... E02D 35/00 405/232
2011/0185649 A1 8/2011 Lin
2020/0208396 A1 * 7/2020 Gantt ..... E04B 1/3511

* cited by examiner

PIER BRACKET ASSEMBLY

CROSS-REFERENCE

This application is related to U.S. provisional application No. 62/522,433, filed Jun. 20, 2017, entitled "PIER BRACKET ASSEMBLY", naming Allen GANTT as the inventor. The contents of the provisional application are incorporated herein by reference in their entirety, and the benefit of the filing date of the provisional application is hereby claimed for all purposes that are legally served by such claim for the benefit of the filing date.

BACKGROUND

A pier bracket assembly is described and, more particularly, a pier bracket assembly for use in an anchor assembly including a structural pier device, such as a helical anchor or a push pier, to provide support to a structure, for example, by underpinning the structure.

Anchor assemblies, including structural pier devices, function under compression as footings or underpinning for structures, such as building foundations, walls, platforms, towers, bridges, and other structures. Anchor assemblies are used in both new construction as well as in the repair of settled and damaged footings and foundations of existing buildings and other structures. Conventional repair systems comprising anchor assemblies lift and support the structure at or near its original unsettled position.

Structural pier devices used in anchor assemblies include helical anchors and push piers. A helical anchor includes a shaft that carries one or more bearing plates, or flights, generally arranged in a helical configuration on the shaft. In use, powered rotation is communicated to the shaft to screw the helical anchor into the ground to bedrock or to load-bearing strata sufficiently stable to support the desired structure. Once inserted into the ground, the structure to be supported may be built or repaired with some or all of its weight carried by the helical anchor. In new construction, a plurality of helical anchors are strategically positioned and hydraulically screwed into the ground to a desired depth. Once in place, the anchors are tied together and interconnected by settling them within reinforced concrete. For settled or damaged structure, helical anchors are often positioned along portions of, and utilized to repair, the structure by lifting and supporting the settling structure.

Push piers are linear shafts hydraulically driven into the ground alongside the structure to be supported until the push piers reach bedrock or a load bearing strata region at which the piers experience a desired amount of resistance sufficient to support the structure. Once a series of push piers are driven into the ground, the structure is raised by a desired amount and fastened to the push piers with a pier bracket assembly. The push piers and bracket assemblies are coupled to one another in order to support the building.

For the foregoing reasons, there is a need for a new pier bracket assembly for use with structural pier devices in an anchor assembly. The pier bracket assembly should be easily secured to the shafts of the structural pier devices, such as helical anchors and push piers, for interconnecting the structure and anchor assemblies for underpinning the structure.

SUMMARY

A pier bracket for use in an anchor assembly including structural piers inserted into ground using a drive assembly.

The pier bracket secures the structural piers to a structure for supporting the structure. The pier bracket comprises a seat, including a base plate and an upper plate extending orthogonally from the base plate. When the base plate is positioned for supporting the structure, the upper plate is adjacent to the structure for securing the upper plate to the structure. A tubular member is mounted to the seat and adapted to slidably receive the structural piers. A planar support plate is distally spaced from and parallel to the base plate. Each of a pair of side plates extends between an opposite side edge of the base plate and the support plate.

An anchor assembly is also provided for underpinning and supporting a structure. The anchor assembly comprises at least one structural pier device for being sunk into the ground. A pier bracket secures the structural pier to the structure. The pier bracket comprises a seat including a base plate and an upper plate extending orthogonally from the base plate. When the base plate is positioned for supporting the structure, the upper plate is adjacent to the structure for securing the upper plate to the structure. A tubular member is mounted to the seat and adapted to slidably receive the structural pier. A planar support plate is distally spaced from and parallel to the base plate. Each of a pair of side plates extends between an opposite side edge of the base plate and the support plate.

BRIEF DESCRIPTION OF THE DRAWINGS

For a more complete understanding of the present invention, reference should now be had to the embodiments shown in the accompanying drawings and described below. In the drawings.

DESCRIPTION

Figure 1:
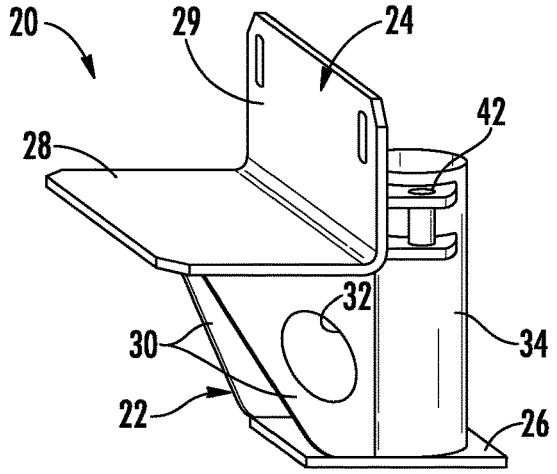
FIG. 1 is a front perspective view of an embodiment of a pier bracket assembly.
Figure 2:
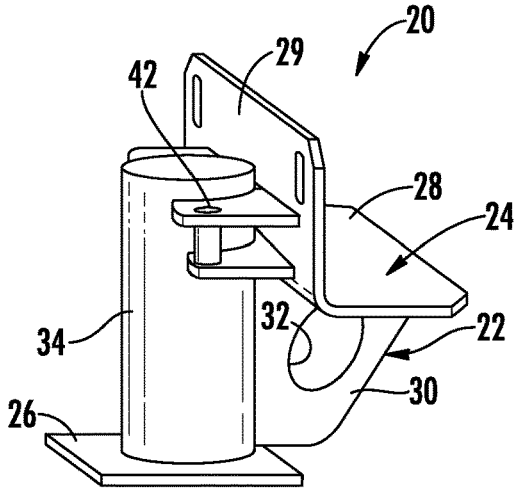
FIG. 2 is a rear perspective view of the pier bracket assembly as shown in FIG. 1.
Figure 3:
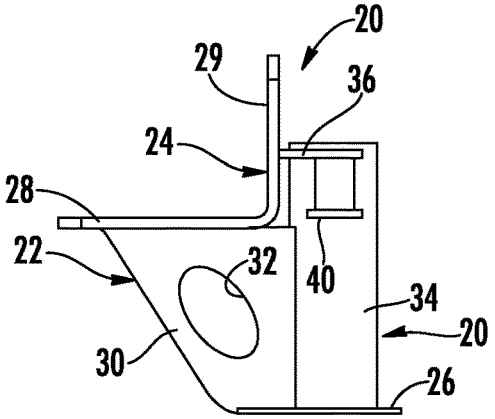
FIG. 3 is a right side elevation view of an embodiment of the pier bracket assembly as shown in FIG. 1.
Figure 4:
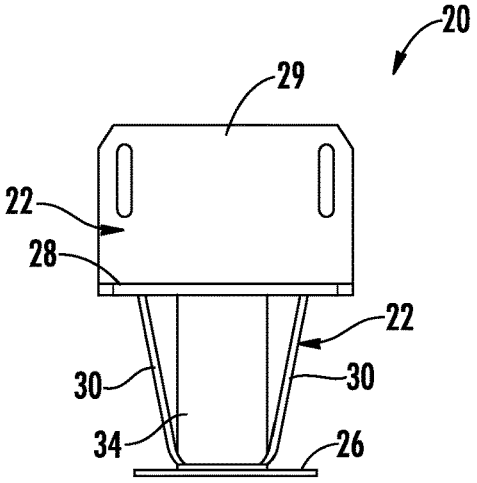
FIG. 4 is a front elevation view of the pier bracket assembly as shown in FIG. 1.
Figure 5:
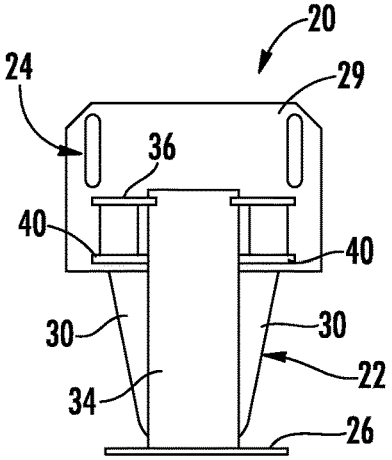
FIG. 5 is a rear elevation view of the pier bracket assembly as shown in FIG. 1.
Figure 6:
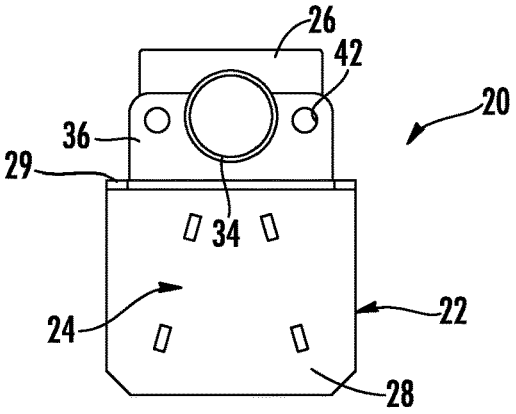
FIG. 6 is a top plan view of the pier bracket assembly as shown in FIG. 1.
Figure 7:
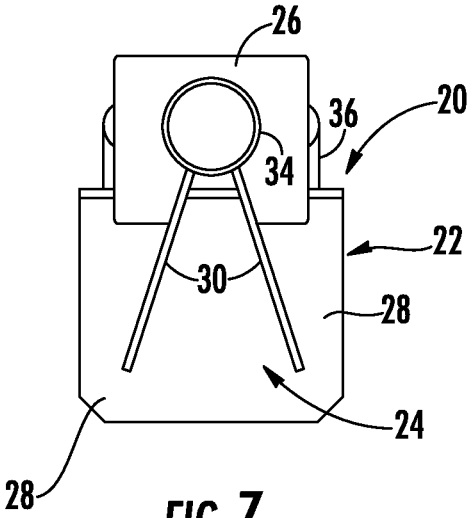
FIG. 7 is a bottom plan view of the pier bracket assembly as shown in FIG. 1.
Figure 8:
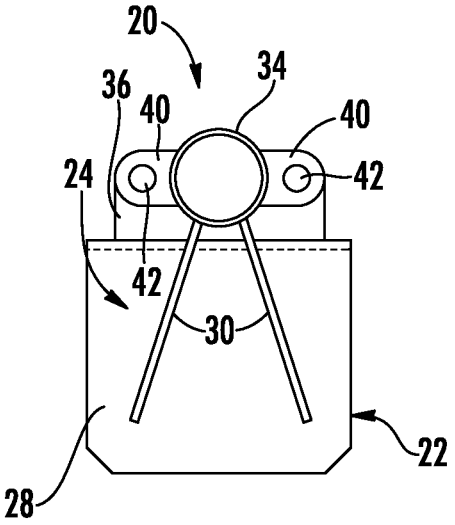
FIG. 8 is a bottom plan view of the pier bracket assembly as shown in FIG. 4 with a sand plate removed for clarity.

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

Referring now to the drawings, wherein like reference numerals designate corresponding or similar elements throughout the several views, an embodiment of a pier bracket assembly is shown in FIGS. 1-8 and generally designated at 20. The pier bracket 20 is configured for use with an anchor assembly including a structural pier device that is inserted into the ground under force in order to support the weight of a structure, such as a building foundation, a wall, footers and the like. The structural pier device may comprise one or more helical anchors or push piers. A method of securing the pier bracket 20 to the structure allows one to interconnect the structural pier device and the structure in the field at the installation site for supporting the structure.

The pier bracket 20 is a one piece monolithic body member 22 comprising an L-shaped seat 24 and a ground-engaging sand plate 26. The L-shaped seat 24 includes a base leg 28 and an orthogonal upper leg 29. The base leg 28 of the L-shaped seat 24 is configured to extend under and support the structure to be supported. The L-shaped seat may be fastened to the structure. For this purpose, a pair of spaced slots 31 are provided in the upper leg 29 for receiving fasteners for securing the pier bracket 20 to the structure. The sand plate 26 provides a base for vertically standing the pier bracket 20 when the pier bracket 20 is not secured to the structure. In the embodiment shown, the shape of the sand plate 26 and the base leg 28 are square and may be of any suitable dimension. In alternative embodiments, the shape may be other than square, such as a rectangular or hexagonal shape.

A pair of truncated triangular side plates 30 extend from and interconnect the base leg 28 of the seat 24 and the sand plate 26. The side plates 30 taper in width from their connection at an upper edge to the base leg 28 to a smaller width at their connection at a lower edge to the sand plate 26. Each of the side plates 30 define oblong openings 32 sized to fit a hand so that an installer has a handhold for carrying the pier bracket 20.

The side plates 30 converge from the outer free edge of the base leg 28 to the inner edge of the base leg. The inner edges of the side plates 30 project beyond the upper leg 29 of the L-shaped seat 24 and are integral with a hollow longitudinal tubular member 34 extending substantially parallel with the upper leg 29. The upper end of the tubular member 34 is secured to the upper leg 29 via a flange 36 connected between a point intermediate the length of the upper leg and the tubular member 34. The tubular member 34 defines an axial through bore configured to receive an elongated sleeve 38 for passing shaft sections of a structural pier device, as will be described below. The sleeve 38 is a hollow steel female tubular element having outer diametrical dimensions larger than that of the structural support devices. The tubular member 34 is shown having a circular transverse cross-section; however, the tubular member may be shaped with a square cross-section if desired as both shafts of circular and square cross-sections are commonly employed in structural pier devices. It is understood that the tubular member 34 may be of different shapes with the principle requirement being that the bore be of polygonal shape for reception of a complementally configured shaft.

Figure 9:
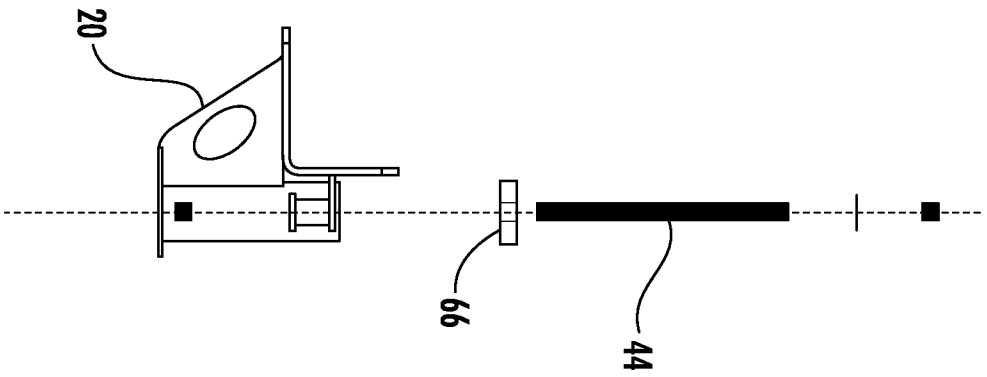
FIG. 9 is an exploded side elevation view of the pier bracket assembly as shown in FIG. 1 including a pier cap and threaded rods for use with the pier bracket assembly.
Figure 10:
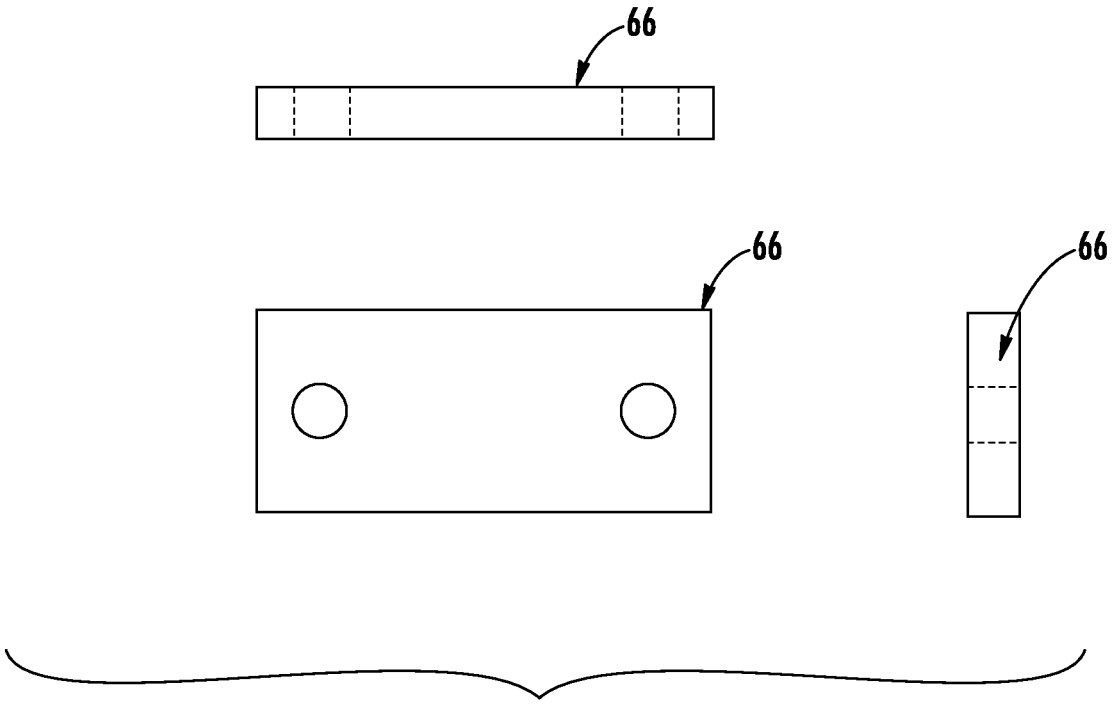
FIG. 10 shows a side view, an end elevation view and a top plan view of an embodiment of a pier cap for use with the pier bracket assembly as shown in FIG. 1.

The tubular member 34 supports a pair of opposed ears 40 extending outwardly from the periphery of the tubular member 34 and parallel with the flange 36. The flange 36 and each of the ears 40 define two pairs of aligned bolt holes 42 so that the pier bracket 20 may be fastened to the underpinning drive assembly. The peripheral edges of both the flange 36 and the ears 40 are rounded at their corners. This configuration greatly facilitates placement of the drive assembly proximate the pier bracket 20 in preparation for driving the structural devices. As best seen in FIG. 9, a threaded rod connector 44 extends through each of the pairs of bolt holes 42 for attachment to the drive assembly (not shown). Nuts and washers are used to attach each rod 44 and a pier cap 66 (FIG. 10) to the pier bracket 20. It is to be understood that any number and size of threaded rods 44 may be used with corresponding pre-drilled bolt holes 42.

In one embodiment, the pier bracket 20 is constructed of galvanized hardened alloy steel to prevent corrosive deterioration of the pier bracket 20 over time.

Figure 11:
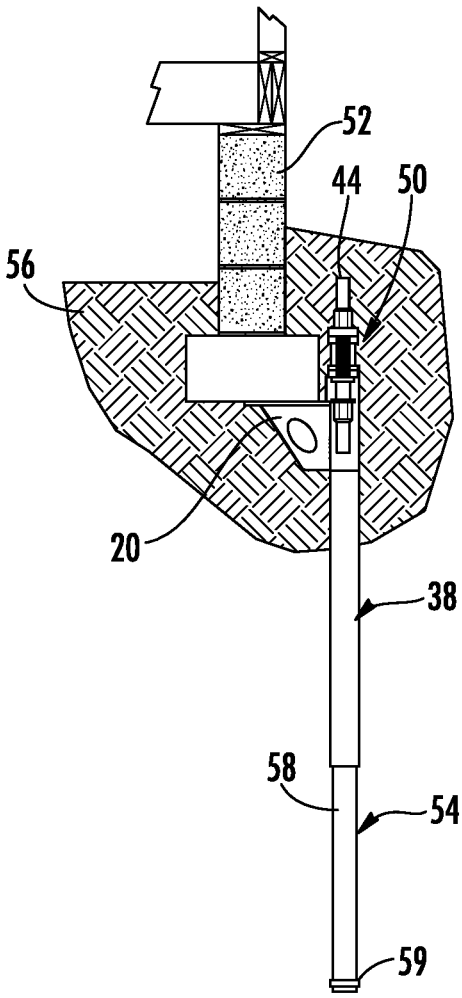
FIG. 11 is a side elevation view of an embodiment of an anchor assembly including the pier bracket assembly as shown in FIG. 1.
Figure 12A:
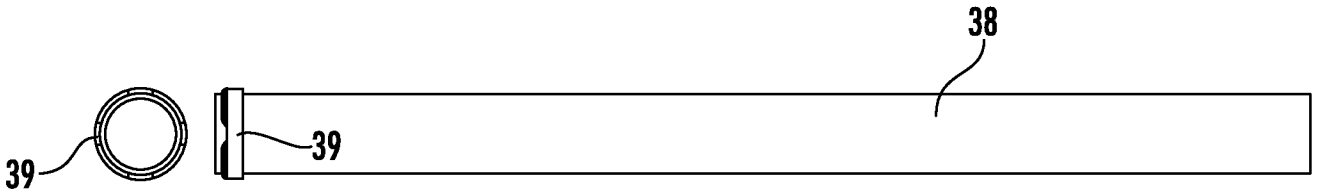
FIGS. 12A and 12B are side elevation views of an embodiment of a welded and flared bracket sleeve, respectively, for use with the pier bracket assembly as shown in FIG. 1.
Figure 12B:
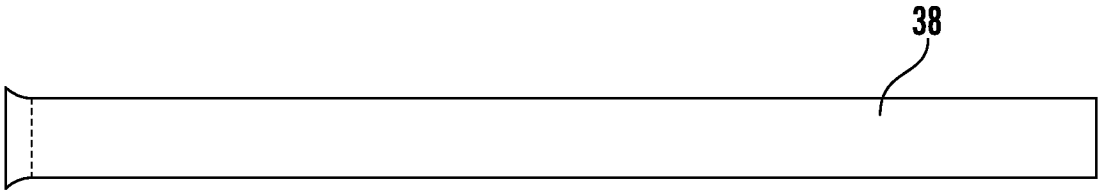

The pier bracket 20 provides a method of forming and inserting into the ground an anchor assembly in the field. The method comprises providing a structural pier device for insertion through the sleeve 38 in the pier bracket 20 in the anchor assembly. The shaft of the structural pier device is inserted through the sleeve 38 and forced into the ground such that the structural pier device is anchored into the ground. Referring to FIG. 11, an assembled anchor assembly, generally designated at 50, is shown supporting a wall 52. The anchor assembly 50 includes a structural pier device in the form of a push pier 54. The sleeve 38 is slidingly received in the tubular member 34 and depends from an inner distal end of the tubular member 34. As shown in FIGS. 12A and 12B, the sleeve 38 has either a ring collar 39 welded to the periphery at a proximal end or the proximal end of the sleeve is flared 41, respectively, to hold the sleeve 38 in the tubular member 34. In either case, the sleeve 38 includes an annular shoulder extending circumferentially around the proximal end. The shoulder 39, 41 has an outer diameter larger than the inner diameter of the bore of the tubular member 34. As seen in FIG. 11, the shoulder serves to act as a stop engaging against the outer end of the tubular member 34.

Figure 13:
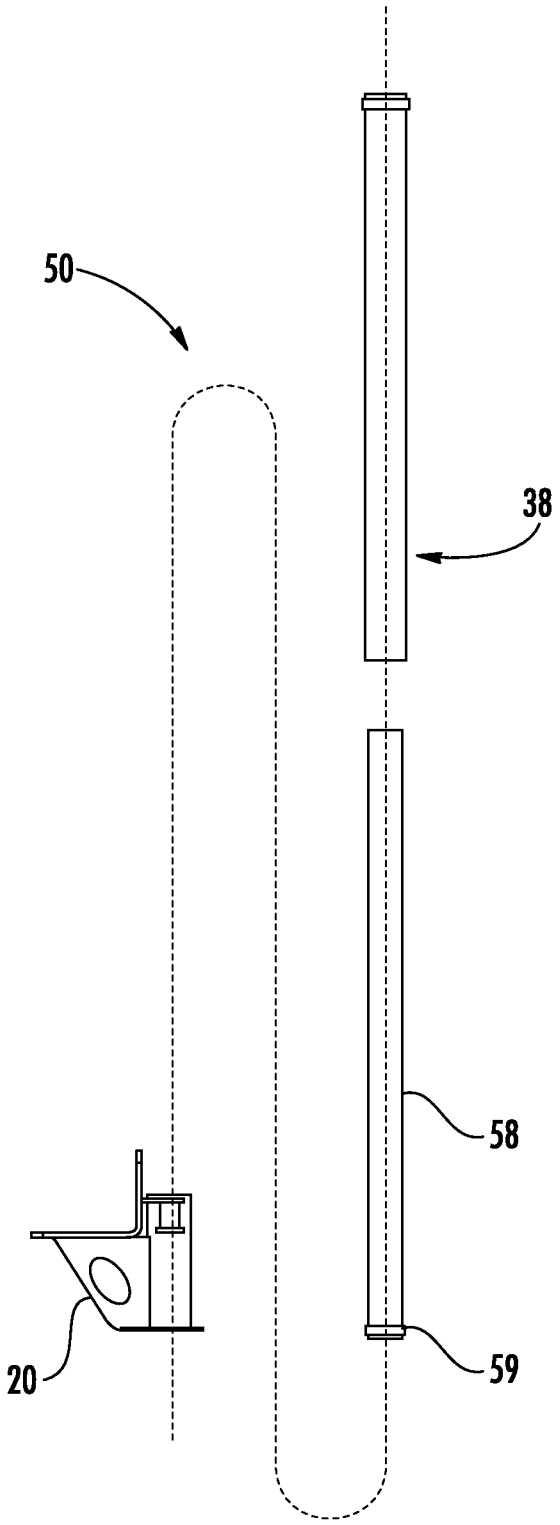
FIG. 13 is an exploded side elevation view of the anchor assembly as shown in FIG. 11.
Figure 14:
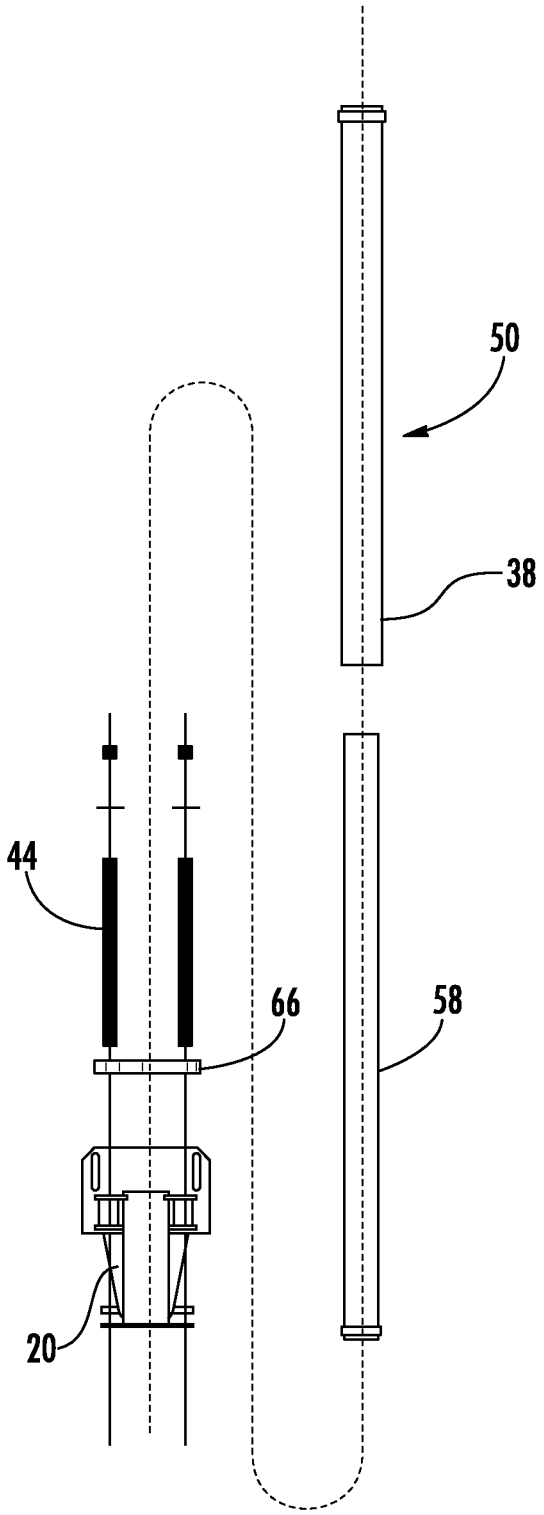
FIG. 14 is an exploded rear elevation view of the pier bracket assembly as shown in FIGS. 11 and 13.

The push pier 54 comprises a plurality of tubular shaft sections inserted through the sleeve 38 and forced into the ground 56 so as to form an anchor to carry the loading of the wall 52. The first of a plurality of shaft sections of the push pier 54 comprise a lower starter, or lead, section 58. As shown in the exploded views of FIGS. 13 and 14, the push pier lead section 58 includes an elongated main tubular shaft section having a proximal end and a distal end. Secured to the lower distal end of the lead section 58 is a ground penetrating member, commonly known in the art as a friction collar 59, to facilitate penetration of the ground upon insertion. The upper outer proximal end of the lead section 58 forms a terminal female coupling end which facilitates connection of an extending shaft to which one or more additional shaft extensions are connected.

Figure 15:
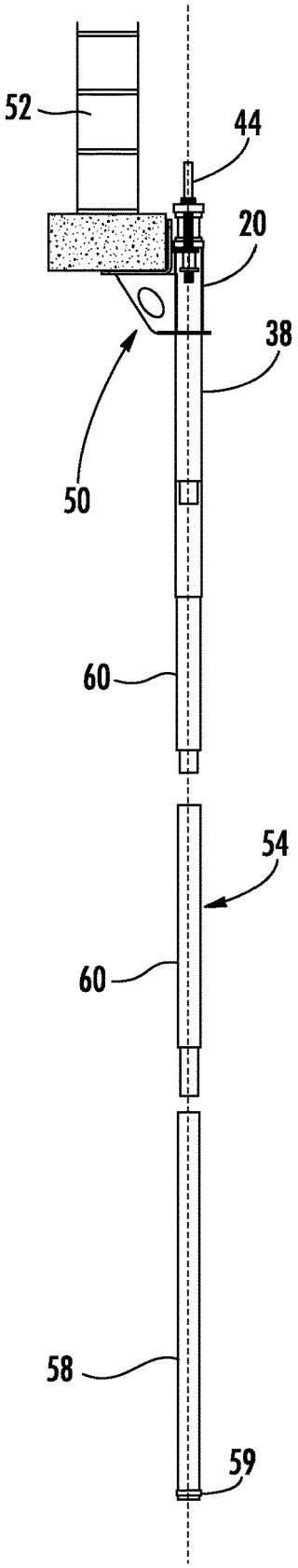
FIG. 15 is a partially exploded side elevation view of the anchor assembly as shown in FIG. 11.
Figure 16:
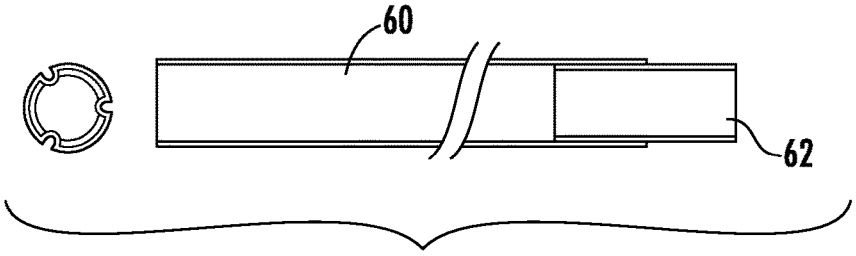
FIG. 16 is an end view and a side elevation view joined structural pier devices.
Figure 17A:
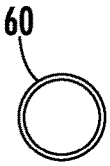
FIGS. 17A, 17B, 17C, 17D, 17E, and 17F are a schematic view of steps in a nipple crimping process for joining tubes of structural pier devices.
Figure 17B:
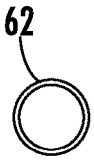
Figure 17C:
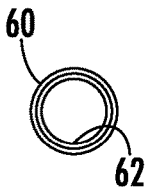
Figure 17D:
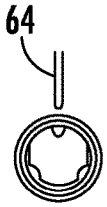
Figure 17E:
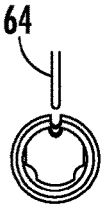
Figure 17F:
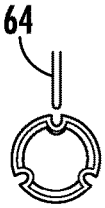

Referring to FIG. 15, additional push pier extension shafts 60 may be added. The shafts 60 have similar inside and outside diametrical dimensions as the push pier lead section 58. Axial end-to-end connection of adjoining shafts may take the form of and be constructed in any of a variety of ways. In a preferred embodiment shown in FIG. 16, the connection is formed by joining the hollow ends of adjoining shafts using a nipple crimping process. The nipple crimping process comprises inserting a hollow tubular coupling insert 62 into the ends of the shaft sections 60. As shown, the coupling insert 62 is in the form of a male coupling element, but it is contemplated that it may take the form of a female coupling element without departing from the scope of the invention herein. The male coupling insert 62 has a reduced outer diameter just slightly less than the inner diameter of the shaft sections so as to facilitate connection thereto. This allows the coupling insert 62 to mate with corresponding female coupling sections of the additional adjoining extension shaft sections.

The coupling insert 62 is fixed in the ends of contiguous shaft sections through the use of the nipple crimping process shown in FIGS. 17A-F. A rounded punch 64 is driven transversely into the joined tubular sections and coupling inserts to form dimples in at least three locations spaced in the circumference of the tubes. This process facilitates attachment of additional extension shafts and creates a fused joint between the two adjoining shafts. In other embodiments, bolts may be utilized to secure adjoining male and female coupling shaft sections. Alternatively, the coupling sections may be welded or threaded together. In the latter embodiment, the female coupling section is comprised of a hollow female tubular element with outer diametrical dimensions the same as or approximating that of the shaft. The interior surface of the female coupling, however, tapers radially inwardly from its free end and is threaded. The male coupling insert is similarly constructed as a hollow tubular member, but has a threaded free end which is reverse-tapered for receipt in the tapered threaded end of the female shaft ends.

In use, initially an area of earth is excavated immediately adjacent a foundation or other structure to expose the footer of the foundation. This excavation area may extend slightly beneath the base of the footer. A chipping hammer is used to prepare the footer for mounting the pier bracket. The vertical and bottom faces of the footer should be free of all dirt, debris and loose concrete to provide firm bearing surfaces for the pier bracket. The pier bracket 20 is mounted on the underpinning drive assembly and then lowered into the excavation area adjacent the foundation. The pier bracket 20 is then seated against the footer and fastened to the foundation through steel concrete anchors. An underpinning anchor assembly is then attached through the pier bracket 20. Using push piers, the installer will slide the sleeve 38 into the tubular member 34. The drive assembly including a hydraulic ram then drives the push piers 54, 58 downward into the ground. Additional shaft sections 60 of the push pier 54 may be added as necessary, until bedrock or a sufficient load bearing strata is reached. Thereafter, the drive assembly is removed from the pier bracket 20 and the foundation is raised to the desired level in a conventional manner.

It is understood that helical anchors could also be used as the structural pier device. When using helical anchors, the helical anchors are secured to the underpinning drive assembly and turned into the ground in the conventional manner. Additional sections of the helical anchor may be added as necessary, until bedrock or a sufficient load bearing strata is reached. Thereafter, the drive assembly is removed. The pier bracket 20 is then slipped over the exposed end of the last helical anchor for interconnecting the helical anchor and the foundation.

The pier bracket assembly has many advantages, including simplified assembly in the field. The flat sand plate 26 allows the pier bracket 20 to stand vertically when not otherwise attached or supported. This feature facilitates assembly of the pier bracket 20 into the anchor assembly.

Although the present pier bracket assembly has been shown and described in considerable detail with respect to only a few exemplary embodiments thereof, it should be understood by those skilled in the art that we do not intend to limit the pier bracket assembly to the embodiments since various modifications, omissions and additions may be made to the disclosed embodiments without materially departing from the novel teachings and advantages of the pier bracket assembly, particularly in light of the foregoing teachings. Accordingly, we intend to cover all such modifications, omission, additions and equivalents as may be included within the spirit and scope of the described pier bracket assembly as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A pier bracket for use in an anchor assembly including one or more structural piers inserted a depth into ground using a drive assembly after securing the pier bracket to a structure, the pier bracket securing the one or more structural piers to the structure and being configured for supporting the structure, the pier bracket comprising:

an L-shaped seat including a base plate, and an upper plate extending from the base plate, wherein the seat is configured to be operatively coupled to the structure;

a tubular member fixedly mounted to the seat, wherein an entirety of an upper end of the tubular member is fixedly mounted below a top portion of the upper plate; and wherein, in a sliding configuration, the tubular member slidably receives a sleeve, the sleeve slidably receives the one or more structural piers for insertion of the one or more structural piers into the ground, and a proximal end of the sleeve is located below the top portion of the upper plate.

2. The pier bracket as recited in claim 1, further comprising one or more side plates for operatively coupling the seat and the tubular member, and wherein at least one of the one or more side plates has an opening therein for providing a handhold for a user.

3. The pier bracket as recited in claim 1, further comprising a flange operatively coupling the seat and the tubular member, and wherein the flange defines a fastener opening adapted for securing the pier bracket to the drive assembly.

4. The pier bracket as recited in claim 1, wherein the base plate comprises a planar rectangular member.

5. The pier bracket as recited in claim 1, further comprising:

a planar support plate, wherein the planar support plate is located below a lower end of the tubular member, wherein the sleeve and the one or more structural piers pass through the planar support plate, and wherein the planar support plate allows the pier bracket to stand vertically in an installed orientation before being operatively coupled to the structure.

6. The pier bracket as recited in claim 1, wherein the sleeve comprises a stop, wherein the tubular member slidingly receive at least a portion the sleeve within the tubular member until the stop of the sleeve engages the tubular member to resist additional movement between the sleeve and the tubular member.

7. The pier bracket as recited in claim 6, wherein the stop is a shoulder comprising a collar operatively coupled to the sleeve or a flared end of the sleeve.

8. The pier bracket as recited in claim 1, further comprising a releasable fastening means for releasably fastening the seat to the structure.

9. The pier bracket as recited in claim 8, wherein the releasable fastening means comprises at least one opening in the upper plate for receiving a fastener for fastening the seat to the structure.

10. An anchor assembly for underpinning and supporting a structure, the anchor assembly comprising:

at least one structural pier for being sunk a depth into ground;

a pier bracket configured for securing the at least one structural pier to the structure, the pier bracket comprising:

an L-shaped seat including a base plate and an upper plate extending from the base plate, wherein the seat is configured to be operatively coupled to the structure, a tubular member fixedly mounted to the seat, wherein an entirety of an upper end of the tubular member is fixedly mounted below a top portion of the upper plate; and a sleeve, wherein the sleeve is hollow therethrough;

wherein, in a sliding configuration:

the tubular member slidingly receives the sleeve;

a proximal end of the sleeve is located below the top portion of the upper plate; and the sleeve slidingly receives the at least one structural pier.

11. The anchor assembly as recited in claim 10, wherein the at least one structural pier is a push pier.

12. The anchor assembly as recited in claim 10, wherein the at least one structural pier is a helical anchor.

13. The anchor assembly as recited in claim 10, further comprising means for releasably fastening the seat to the structure.

14. The anchor assembly as recited in claim 10, further comprising one or more side plates that operatively couple seat and the tubular member, wherein at least one of the one or more side plates has an opening therein for providing a handhold for a user.

15. The anchor assembly as recited in claim 10, further comprising a flange that operatively couple the seat and the tubular member, and wherein the flange defines a fastener opening adapted for securing the pier bracket to a drive assembly.

16. The anchor assembly as recited in claim 10, wherein the base plate comprises a planar rectangular member.

17. The anchor assembly as recited in claim 10, wherein the at least one structural pier comprises a plurality of structural piers connected end to end.

18. The anchor assembly as recited in claim 10, wherein the pier bracket further comprising:

a planar support plate, wherein the planar support plate is located below a lower end of the tubular member, wherein the sleeve and the at least one structural pier pass through the planar support plate, and wherein the planar support plate allows the pier bracket to stand vertically in an installed orientation before being operatively coupled to the structure.

19. The anchor assembly as recited in claim 10, wherein the sleeve comprises a stop, wherein the tubular member slidingly receive the sleeve within the tubular member until the stop of the sleeve engages the tubular member to resist additional movement between the sleeve and the tubular member.

20. The anchor assembly as recited in claim 19, wherein the stop is a shoulder comprising a collar operatively coupled to the sleeve or a flared end of the sleeve.

* * * * *